US006767372B2

(12) United States Patent
Barnes et al.

(10) Patent No.: US 6,767,372 B2
(45) Date of Patent: Jul. 27, 2004

(54) AVIATION GASOLINE CONTAINING REDUCED AMOUNTS OF TETRAETHYL LEAD

(75) Inventors: Fred E. Barnes, Walnut Creek, CA (US); Gregory Hemighaus, Richmond, CA (US); William R. Scott, El Cerrito, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/942,913

(22) Filed: Aug. 31, 2001

(65) Prior Publication Data

US 2002/0055663 A1 May 9, 2002

Related U.S. Application Data

(60) Provisional application No. 60/229,309, filed on Sep. 1, 2000.

(51) Int. Cl.[7] ..... C10L 1/10
(52) U.S. Cl. ..... 44/300; 585/14
(58) Field of Search ..... 44/300; 585/14

(56) References Cited

U.S. PATENT DOCUMENTS

| | | | | |
|---|---|---|---|---|
| 4,633,028 A | | 12/1986 | Owen et al. | |
| 4,659,338 A | | 4/1987 | Johnston et al. | |
| 4,804,389 A | | 2/1989 | Johnston et al. | |
| 4,812,146 A | | 3/1989 | Jessup | |
| 5,160,350 A | | 11/1992 | Stoldt | |
| 5,210,348 A | | 5/1993 | Hsieh et al. | |
| 5,401,280 A | | 3/1995 | Kaneko et al. | |
| 5,470,358 A | | 11/1995 | Gaughan | |
| 5,762,050 A | | 6/1998 | Gonzalez | |
| 5,851,241 A | | 12/1998 | Studzinski et al. | |
| 5,962,775 A | | 10/1999 | Liiva et al. | |
| 6,238,446 B1 | * | 5/2001 | Henderson | 44/359 |
| 6,451,075 B1 | * | 9/2002 | Schoppe et al. | 44/454 |

FOREIGN PATENT DOCUMENTS

| | | | |
|---|---|---|---|
| GB | 2 106 933 | | 4/1983 |
| WO | 9822556 | * | 5/1998 |

OTHER PUBLICATIONS

International Search Report dated Jun. 12, 2002 in PCT/US01/27045.

* cited by examiner

*Primary Examiner*—Cephia D. Toomer
(74) *Attorney, Agent, or Firm*—Burns, Doane, Swecker & Mathis, L.L.P.

(57) ABSTRACT

An aviation gasoline (Avgas) fuel composition possessing a high motor octane number and which contains reduced amounts of tetraethyl lead is disclosed. The Avegas composition preferably comprises about 20 to about 80 vol % iso-octane, about 5 to about 18 vol % toluene, about 1 to about 20 vol % $C_4$ to $C_5$ paraffins, about 0 to about 1 ml/gallon tetraethyl lead (TEL) and the balance light alkylate. The Avgas composition may be economically produced utilizing spare methyl tertiary butyl ether plant capacity to produce iso-octane as one component of the composition.

29 Claims, 1 Drawing Sheet

AVIATION GASOLINE CONTAINING REDUCED AMOUNTS OF TETRAETHYL LEAD

CROSS-REFERENCE TO RELATED APPLICATIONS

This application claims the benefit of U.S. Provisional Application No. 60/229,309, filed Sep. 1, 2000, incorporated herein in its entirety.

BACKGROUND OF THE INVENTION

1. Field of the Invention

The present invention relates to fuels, particularly aviation gasoline (Avgas) formulations, which contain reduced amounts of tetraethyl lead. More specifically, the present invention relates to an aviation gasoline formulation possessing a high motor octane number which contains reduced amounts of tetraethyl lead and a method of economically making the aviation gasoline formulation utilizing available excess methyl tertiary butyl ether (MTBE) plant production capacity.

2. Brief Description of Art

Aviation gasoline (Avgas) generally contains an aviation alkylate base fuel and a lead-based additive package. A conventional Avgas formulation contains light alkylate, toluene, $C_4$ to $C_5$ paraffins and tetraethyl lead. Current formulations generally comprise 75–92 vol % light alkylate, 5–18 vol % toluene, 3–20 vol % $C_4$ to $C_5$ paraffins and 2–4 ml/gallon tetraethyl lead (TEL). The industry standard Grade 100 aviation gasoline contains up to 4 ml of TEL/gallon of fuel while Grade 100LL (low lead) aviation gasoline contains up to 2 ml TEL/gallon of fuel. Tetraethyl lead is conventionally added as an octane booster to improve the anti-knock properties of the Avgas fuel over the anti-knock properties of the aviation alkylate base fuel.

The use of tetraethyl lead in fuels, particularly in automotive gasolines, has been restricted for many years due, in part, to health and environmental concerns as well as catalyst poisoning effects in automobile catalytic convertors. Aviation gasolines have been allowed to contain tetraethyl lead since no suitable substitute has been found with adequate knock resistance to allow the current fleet of aircraft engines to operate properly. Current U.S. regulations set a maximum amount of tetraethyl lead in aviation fuels at 4.0 ml/gallon. The continued use of tetraethyl lead nonetheless remains an environmental and health concern which has not been completely resolved. The possibility of further restrictions, or a prohibition, on the use of tetraethyl lead in aviation gasolines therefore exists.

Alternatives to the use of tetraethyl lead are known in the fuel art. For example, methylcyclopentadienyl manganese tricarbonyl (MMT) has been used as an antiknock agent in motor fuels since around 1975, first as a supplement to leaded agents, and then as a replacement to produce lead-free gasoline. However, questions have also been raised concerning the production of undesirable emissions using MMT.

The primary oxygen-containing compounds employed in gasoline fuels today are methyl tertiary butyl ether (MTBE) and ethanol. The use of MTBE as an oxygenate in fuels, however, is also currently under investigation due to health and environmental concerns. For example, MTBE has been observed in drinking water reservoirs, and in a few instances, in ground water in certain areas of California and other States. As a consequence, the benefits of having an ether oxygenate such as MTBE in gasolines, particularly motor gasolines, where its use may also create health and environmental risks, is being questioned.

Current legislation restricts the use of MTBE in fuels and its storage in underground tanks. In California, for example, Executive Order D-5-99 and Senate Bill 989 require the use of MTBE in gasoline to be phased-out beginning Dec. 31, 2002. Current proposals would require a prohibition on MTBE in California gasoline containing 0.3 vol % or more of MTBE beginning Dec. 31, 2002. Starting Dec. 31, 2003, the prohibition would be reduced to 0.15 vol % or more of MTBE. A permanent prohibition of 0.05 vol % or more of MTBE in gasoline would begin Dec. 31, 2004.

As a result of restrictions on the use of MTBE, and the phasing-out of its use in California, a concern has been raised over the possibility of stranded investments in MTBE plant production capacity. A need therefore exists to economically utilize this spare capacity. One possible option is to convert MTBE production capacity to the production of di-isobutylene, which is then hydrogenated to form a mixture of isoparaffins, predominately 2,2,4-trimethylpentane or "iso-octane." Iso-octane derived from such a process may then be used to form the aviation gasoline composition of the present invention.

U.S. Pat. No. 5,470,358 (Gaughan) discloses an unleaded aviation gasoline for use in piston driven aircraft having a motor octane number of at least about 98 which comprises an unleaded aviation gasoline base fuel and at least one aromatic amine. The fuel compositions typically comprise from 4–20 wt. % of the aromatic amines and may further contain other conventional octane boosters, such as benzene, toluene, xylene, MTBE and MMT.

U.S. Pat. No. 4,812,146 (Jessup) discloses a liquid fuel composition having an octane rating of at least about 100 comprising toluene, an alkylate and at least two further components selected from the group consisting of isopentane, n-butane and MTBE.

U.S. Pat. No. 5,851,241 (Studzinski et al) discloses an Avgas composition containing a combination of non-lead additives including an alkyl tertiary butyl ether and an aromatic amine as an additive package.

The disclosures of each of the above-referenced patents are incorporated herein by reference.

In view of the current limitations placed on the use of tetraethyl lead and alkyl tertiary butyl ethers such as MTBE, it is desirable to produce Avgas compositions which contain reduced levels of lead, or do not require the presence of lead-based additives or ether compounds, such as alkyl tertiary butyl ethers.

It is therefore an object of the present invention to provide an aviation gasoline formulation possessing a high motor octane number which contains reduced amounts of tetraethyl lead. It is a further object to provide the aviation gasoline formulation without the required addition of octane boosters such as, for example, MTBE or other ether compounds, amine compounds and MMT.

It is another object of the present invention to provide a method of preparing an aviation gasoline formulation possessing a high motor octane number which contains reduced amounts of tetraethyl lead by blending of the aviation gasoline formulation components.

Yet another object is to provide a method of economically making an aviation gasoline formulation possessing a high motor octane number which contains reduced amounts of tetraethyl lead utilizing available methyl tertiary butyl ether (MTBE) plant production capacity.

These and other objects of the present invention will become apparent upon a review of the following description, the FIGURE of the Drawing, and the claims appended hereto.

SUMMARY OF THE INVENTION

In accordance with the foregoing objectives, the present invention provides an aviation gasoline (Avgas) formulation possessing a high motor octane number which contains reduced amounts of tetraethyl lead.

The Avgas formulation of the present invention preferably comprises about 20 to about 80, more preferably about 30 to about 70, and most preferably about 40 to about 60 vol % iso-octane, about 5 to about 18 vol % toluene, about 1 to about 20 vol % $C_4$ to $C_5$ paraffins, from 0 to about 1 ml/gallon tetraethyl lead (TEL) and the balance comprising light alkylate.

In a related embodiment, the aviation gasoline formulation is produced by blending of the formulation components or as a product of refinery operations. More particularly, the Avgas composition of the present invention may be produced utilizing spare or excess MTBE plant production capacity.

In an additional embodiment, the present invention provides a method for operating an aircraft having a spark-ignited internal combustion engine, comprising introducing the aviation fuel composition of the present invention into the engine, and combusting the aviation gasoline in the engine.

In a further embodiment, the present invention also provides a method for preparing a reduced lead content aviation gasoline while maintaining a high motor octane number by blending an aviation gasoline with iso-octane and, optionally, toluene.

BRIEF DESCRIPTION OF THE FIGURES OF THE DRAWING

The FIGURE of the Drawing schematically depicts a process for making iso-octane from iso-butylene using spare MTBE plant capacity.

DETAILED DESCRIPTION OF THE PREFERRED EMBODIMENTS OF THE INVENTION

Figure 1:
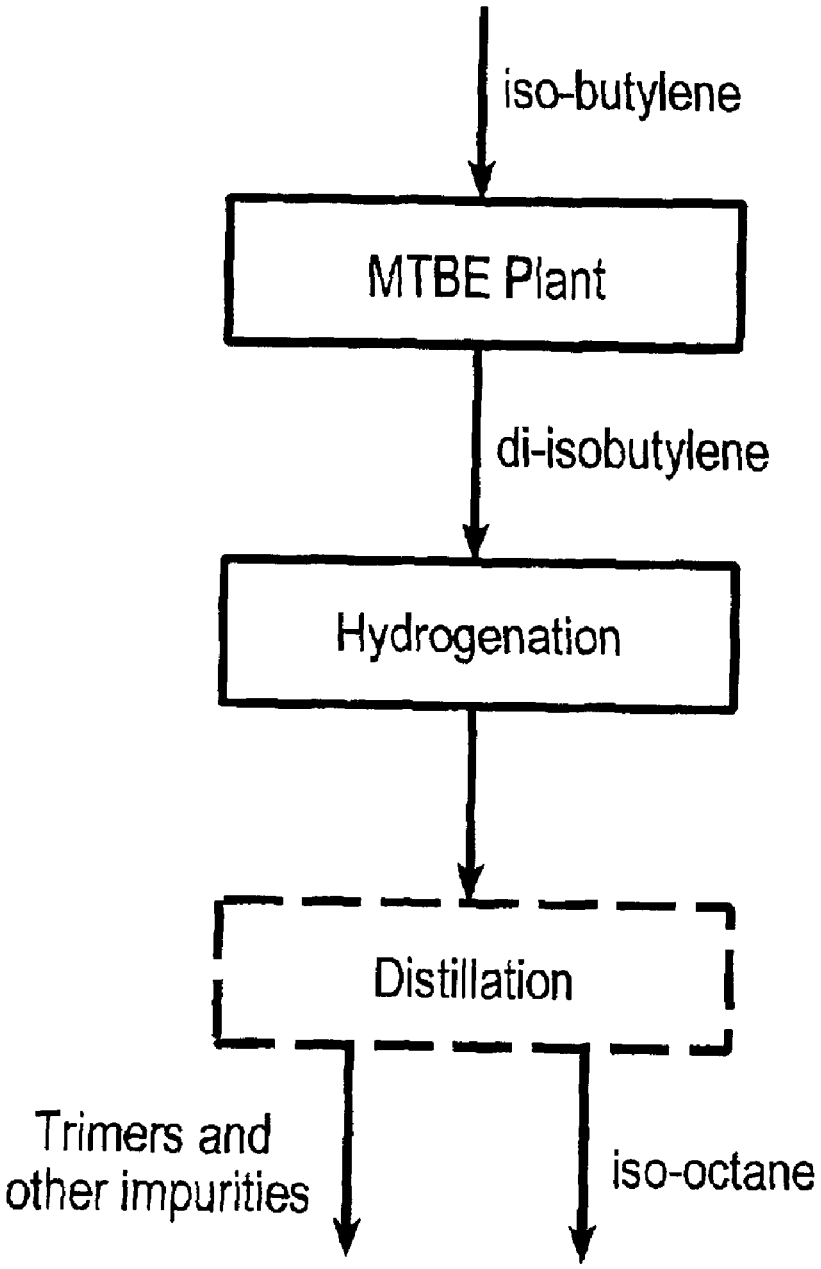

The present invention provides an aviation gasoline (Avgas) formulation possessing a high motor octane number which contains reduced amounts of tetraethyl lead. The Avgas composition preferably meets or exceeds the standards for Grade 100 LL aviation gasoline by requiring less tetraethyl lead while still satisfying the other Grade 100 LL formulation requirements.

The Avgas composition of the invention is compatible with current fuels. By comparison, completely unleaded fuel product may or may not be compatible with current aviation fuels.

The phrase "high motor octane number" is intended to refer to motor octane numbers (MON) which are preferably greater than about 98 and more preferably greater than or equal to about 100. It is preferred that the Avgas composition of the present invention possess a MON which is greater than 98 and more preferably greater than or equal to about 100.

The terms "motor octane number" and "research octane number" are well known in the fuel art. As is further known in the art, aviation fuels are characterized according to the motor octane number (MON), while motor fuels are characterized by the sum or the research octane number (RON) and MON divided by 2, i.e. (R+M)/2.

It is preferred that the Avgas composition of the invention be suitable as a substitute for Grade 100LL aviation fuel. The Avgas composition preferably meets or exceeds the standards for Grade 100LL aviation fuel. Current Grade 100LL standards according to ASTM D910 are shown in Table I.

TABLE I

Product Property Data Requirements for Aviation Gasoline Grade 100 LL (ASTM D910)

| Product Property | Test Method | Min/ Max | Requirements |
|---|---|---|---|
| Knock Value, Lean mixture | ASTM D2700 | Min | 99.5 |
| Knock Value, Rich mixture | ASTM D909 | Min | 130.0 |
| Tetraethyl Lead Content, ml/gal. | ASTM D5059 | Max | 2.0 |
| Color | ASTM D2392 | | Blue |
| Blue Dye, mg/gal | | Max | 10.2 |
| Gravity, API @ 60° F. | ASTM D4052 | | Report |
| Vapor Pressure, psi | ASTM D5191 | Min | 5.5 |
| | | Max | 7.0 |
| Distillation | ASTM D86 | | |
| Initial Boiling Point | | | Report |
| 10% Evap., ° F. | | Max | 167 |
| 40% Evap., ° F. | | Min | 167 |
| 50% Evap., ° F. | | Max | 221 |
| 90% Evap., ° F. | | Max | 275 |
| End Point, ° F. | | Max | 338 |
| Sum of 10% & 50% Evap. Temp., ° F. | | Min | 307 |
| Distillation Recovery, vol. % | | Min | 97 |
| Residue, vol % | | Max | 1.5 |
| Distillation Loss, vol. % | | Max | 1.5 |
| Freezing Point, ° F. | ASTM D2386 | Max | −72 |
| Sulfur, wt % | ASTM D2622 | Max | 0.05 |
| Net Heat of Combustion, Btu/lb. | ASTM D3338 | Min | 18,720 |
| Corrosion, Cu strip, 2 Hrs at 212° F. | ASTM D130 | Max | 1 |
| Potential Gum, (5 hr aging gum) mg/100 ml | ASTM D873 | Max | 6.0 |
| Lead Precipitate, mg/100 ml | ASTM D873 | Max | 3.0 |
| Water Reaction | ASTM D1094 | | |
| Interface Rating | | Max | 2 |
| Vol. change, ml. | | Max | 2 |
| Conductivity | ASTM D2624 | Max | 450 |

By "reduced levels of tetraethyl lead," it is meant that the aviation gasoline composition preferably contains tetraethyl lead in an amount which is less than the 4 ml/gallon allowable maximum limit for aviation gasolines, more preferably less than about 2 ml/gallon and most preferably about 0 to about 1 ml/gallon tetraethyl lead. The same amounts are also preferred for substitutes for tetraethyl lead, such as, for example, tetramethyl lead (though not currently allowed).

The Avgas formulation of the present invention preferably comprises about 20 to about 80, more preferably about 30 to about 70, and most preferably about 40 to about 60 vol % iso-octane, about 5 to about 18 vol % toluene, about 1 to about 20 vol % $C_4$ to $C_5$ paraffins, about 0 to about 1 ml/gallon tetraethyl lead (TEL) and the balance comprising light alkylate.

In one embodiment, the Avgas composition of the present invention is preferably substantially free of ether compounds, particularly alkyl tertiary butyl ether compounds, such as methyl tertiary butyl ether or ethyl tertiary butyl ether. In addition, the Avgas composition of the present invention is preferably substantially free of amine compounds, including aliphatic or aromatic amine compounds.

In a further embodiment, the Avgas composition of the present invention is preferably substantially free of tri-isobutylene and/or other isomers of $C_{12}$ isoparaffins.

The term "iso-octane" is conventionally recognized in the fuel art and herein to refer to 2,2,4-trimethylpentane. Iso-octane is defined in the fuel art and herein as having a motor octane number of 100.

The phrase "substantially free of" is intended to mean that a particular specified component is not purposely added to the Avgas composition. In general, on a weight basis, "substantially free of" means that less than about 0.1 wt. %, more preferably less than about 0.05 wt. %, and most preferably less than about 0.01 wt. % of a particular compound is present in the blended aviation gasoline composition. On a volume basis, "substantially free of" means that less than about 0.1 vol %, more preferably less than about 0.05 vol %, and most preferably less than about 0.01 vol % of a particular compound is present in the blended aviation gasoline composition.

With respect to tetraethyl lead and other lead-based additives, "substantially free of" is intended to mean that preferably less than about 0.1 ml/gallon, more preferably less than about 0.05 ml/gallon of tetraethyl lead and/or such additives are present in the blended aviation gasoline composition.

With respect to ether compounds, such as MTBE, ethyl t-butyl ether (ETBE) and t-amyl methyl ether (TAME), "substantially free of" is intended to mean that preferably less about 0.3 vol %, more preferably less than about 0.15 vol % and most preferably less than about 0.05 vol % is present in the composition.

The term "alkylate" as used herein refers to a fluid containing iso-octane or a mixture of organic compounds containing at least 75 wt. %, preferably at least 90 wt. %, branched chain paraffins, wherein the mixture has a research octane number (RON) greater than 93 and a motor octane number (MON) greater than 91. The term "organic compound" refers to a compound containing at least one carbon atom. Preferred alkylates are hydrocarbons which are readily available, e.g., as the product of an alkylation unit in oil refineries using hydrogen fluoride or $H_2SO_4$ as a catalyst, the catalyst being used to promote the conversion of small paraffins and olefins to relatively large branched chain paraffins. Alkylates produced from an alkylation unit using hydrogen fluoride catalyst may contain at least 75%, preferably at least 80%, more preferably at least 85%, and most preferably at least 90% branched chain paraffins, the remainder usually being other organic compounds, e.g., straight chain paraffins, aromatics, etc. Impurity levels in typical alkylates are generally low. Usually, the balance of the alkylate, i.e., the portion not branched chain paraffins, will be at least 50% by volume of straight chain paraffins. Typical alkylates boil in the 75° F. to 410° F. range, or in any range there between. One preferred mixed light alkylate for Avgas has an initial boiling point in the range of 75° F. to 110° F., preferably about 90 to 100° F., and an end boiling point in the range of 230° F. to 300° F., preferably about 250° F. A mixed alkylate will often comprise a major amount of iso-octane.

The term "light alkylate" as used herein refers to a mixture of $C_6$ to $C_9$ isoparaffins. Trimethylpentane isomers are the major products of alkylation, but the product also contains other isoparaffins. Light alkylate may be distinguished from iso-octane by its lower octane number.

The Avgas composition of the present invention may also comprise certain additives which are approved for aviation fuels. In particular, additives such as color dyes, anti-lead deposit formation compounds, oxidation inhibitors, corrosion inhibitors, fuel system icing inhibitor and static dissipator additives may also be added, as well as other conventional aviation fuel additives.

One possible process for making an Avgas composition according to the invention is schematically depicted in the FIGURE. According to this process, spare MTBE plant capacity is utilized to form di-isobutylene which is then further hydrogenated. In general, the iso-octane purity from such a plant is satisfactory for motor gasoline, and no further distillation is necessary. For making Avgas which contains iso-octane, further processing by distillation may be utilized to improve product purity. Iso-octane derived from such a process may then be used as one component of the Avgas composition of the present invention.

Although the Avgas composition of the invention may be prepared according to such a method, no particular restriction is intended to be imposed upon the production method for the aviation gasoline of the invention.

The present invention will be further illustrated by the following Examples, which are provided for illustration purposes only without limiting the invention. Where percentages are mentioned in the following Examples, and throughout the specification, the parts and percentages are by volume unless otherwise specified.

EXAMPLES

Blending of Aviation Gasoline with Iso-octane

Blend 1

A conventional Grade 100LL avaition gasoline was diluted 50% by volume with iso-octane. The original aviation gasoline contained about 20 vol % $C_5$ paraffins, 65 vol % light alkylate, 15 vol % toluene and 1.8 ml TEL/gal. The original Avgas motor octane number (MON) was 102.2. The blend contained about 10 vol % $C_5$ paraffins, 32.5 vol % light alkylate, 7.5 vol % toluene, 50 vol % iso-octane and 0.9 ml TEL/gal. This blend had a MON of 103.4.

Blend 2

A second blend using the same conventional Grade 100LL avaition gasoline was prepared as follows: 50 vol % Avgas, 42.5 vol % iso-octane, and 7.5% toluene. The blend contained about 10 vol % $C_5$ paraffins, 32.5 vol % light alkylate, 15 vol % toluene, 42.5 vol % iso-octane and 0.9 ml TEL/gal. This blend had a MON of 102.6.

While the invention has been described according to preferred embodiments, it is to be understood that variations and modifications may be resorted to as will be apparent to those skilled in the art. Such variations and modifications are to be considered purview and the scope of the claims appended hereto.

What is claimed is:

1. An aviation gasoline composition possessing a high motor octane number and containing reduced amounts of tetraethyl lead comprising.

about 20 to about 80 vol % iso-octane, about 5 to about 18 vol % toluene, about 1 to about 20 vol % $C_4$ to $C_5$ paraffins, greater than 0 to about 1 ml tetraethyl lead/gallon of said aviation gasoline composition and the balance being light alkylate produced in an alkylation unit using hydrogen fluoride or $H_2SO_4$ as a catalyst.

2. The aviation gasoline composition of claim 1, wherein the motor octane number is at least about 98.

3. The aviation gasoline composition of claim 1, wherein the motor octane number is at least about 100.

4. The aviation gasoline composition of claim 1, comprising about 30 to about 70 vol % iso-octane.

5. The aviation gasoline composition of claim 1, comprising about 40 to about 60 vol % iso-octane.

6. A method of preparing an aviation gasoline blend possessing a high motor octane number and containing reduced amounts of tetraethyl lead comprising:

a) providing an aviation gasoline comprising toluene, $C_4$ to $C_5$ paraffins, tetraethyl lead, and light alkylate produced in an alkylation unit using hydrogen fluoride or $H_2SO_4$ as a catalyst; and b) blending the aviation gasoline with iso-octane; and c) isolating an aviation gasoline blend comprising about 20 to about 80 vol % iso-octane, about 5 to about 18 vol % toluene, about 1 to about 20 vol % $C_4$ to $C_5$ paraffins, greater than 0 to about 1 ml tetraethyl lead/gallon of aviation gasoline blend and the balance being the light alkylate.

7. The method of claim 6, wherein the motor octane number of the aviation gasoline blend is at least about 98.

8. The method of claim 6, wherein the motor octane number of the aviation gasoline blend is at least about 100.

9. The method of claim 6, wherein the aviation gasoline blend comprises comprising about 30 to about 70 vol % iso-octane.

10. The method of claim 6, wherein the aviation gasoline blend comprises about 40 to about 60 vol % iso-octane.

11. A method for operating an aircraft having a spark-ignited internal combustion engine, comprising:

a) introducing the aviation gasoline composition of claim 1 into the engine;

and b) combusting the aviation gasoline composition in the engine.

12. The method of claim 11, wherein the motor octane number of the aviation gasoline composition is at least about 98.

13. The method of claim 11, wherein the motor octane number of the aviation gasoline composition is at least about 100.

14. The method of claim 11, wherein the aviation gasoline blend composition comprises comprising about 30 to about 70 vol % iso-octane.

15. The method of claim 1, wherein the aviation gasoline composition comprises comprising about 40 to about 60 vol % iso-octane.

16. A method of preparing a reduced lead content aviation gasoline blend while maintaining a high motor octane number comprising:

a) providing an aviation gasoline comprising toluene, $C_4$ to $C_5$ paraffins tetraethyl lead, and light alkylate produced in an alkylation unit using hydrogen fluoride or $H_2SO_4$ as a catalyst; and b) blending the aviation gasoline composition with iso-octane and toluene; and c) isolating a reduced lead content aviation gasoline blend comprising about 20 to about 80 vol % iso-octane, about 5 to about 18 vol % toluene, about 1 to about 20 vol % $C_4$ to $C_5$ paraffins, greater than 0 to about 1 ml tetraethyl lead/gallon of so reduced lead content aviation gasoline bleoposition and the balance being the comprising light alkylate.

17. The method of claim 16, wherein the motor octane number of the reduced lead content aviation gasoline blend is at least about 98.

18. The method of claim 16, wherein the motor octane number of the reduced lead content aviation gasoline blend is at least about 100.

19. The method of claim 16, wherein the reduced lead content aviation gasoline blend comprises about 30 to about 70 vol % iso-octane.

20. The method of claim 16, wherein the reduced lead content aviation gasoline blend comprises about 40 to about 60 vol % iso-octane.

21. The aviation gasoline composition according to claim 1, wherein said aviation gasoline composition is substantially free of ether compounds.

22. The method of claim 6, wherein said aviation gasoline blend is substantially free of ether compounds.

23. The method of claim 11, wherein said aviation gasoline composition is substantially free of ether compounds.

24. The method of claim 16, wherein the reduced lead content aviation gasoline blend is substantially free of ether compounds.

25. The aviation gasoline blend according to claim 1, wherein the alkylation unit is in an oil refinery.

26. The method of claim 6, wherein the alkylation unit is in an oil refinery.

27. The method of claim 16, wherein the alkylation unit is in an oil refinery.

28. An aviation gasoline blend possessing a high motor octane number and containing reduced amounts of tetraethyl lead comprising:

a) iso-octane; and b) an aviation gasoline comprising toluene, $C_4$ to $C_5$ paraffins, tetraethyl lead, and light alkylate produced in an alkylation unit in an oil refinery;

wherein the aviation gasoline blend comprises about 20 to about 80 vol % iso-octane, about 5 to about 18 vol % toluene, about 1 to about 20 vol % $C_4$ to $C_5$ paraffins, greater than 0 to about 1 ml tetraethyl lead/gallon of aviation gasoline blend, and the balance being the light alkylate.

29. An aviation gasoline blend possessing a high motor octane number and containing reduced amounts of tetraethyl lead comprising:

a) iso-octane; and b) an aviation gasoline comprising toluene, $C_4$ to $C_5$ paraffins, tetraethyl lead, and light alkylate produced in an alkylation unit using hydrogen fluoride or $H_2SO_4$ as a catalyst;

wherein the aviation gasoline blend comprises about 20 to about 80 vol % iso-octane, about 5 to about 18 vol % toluene, about 1 to about 20 vol % $C_4$ to $C_5$ paraffins, greater than 0 to about 1 ml tetraethyl lead/gallon of aviation gasoline blend, and the balance being the light alkylate.

* * * * *

UNITED STATES PATENT AND TRADEMARK OFFICE

CERTIFICATE OF CORRECTION

PATENT NO. : 6,767,372 B2
DATED : July 27, 2004
INVENTOR(S) : Fred E. Barnes et al.

It is certified that error appears in the above-identified patent and that said Letters Patent is hereby corrected as shown below:

Column 6,
Line 55, please delete "." after the word "comprising" and insert -- : -- in place thereof.

Column 7,
Line 43, please delete "claim 1," and insert -- claim 11, -- in place thereof.

Column 8,
Line 1, please delete "bleoposition" and insert -- blend -- in place thereof.
Line 2, please delete "comprising".

Signed and Sealed this

Twelfth Day of July, 2005

JON W. DUDAS
*Director of the United States Patent and Trademark Office*